United States Patent [19]

Plaza

[11] Patent Number: 4,573,243

[45] Date of Patent: Mar. 4, 1986

[54] SLIDING HOOK DEVICE FOR CLASPING PEARL OR GLASS BEAD NECKLACES THAT HAVE A FREE HANGING END

[75] Inventor: Jaime P. Plaza, Barcelona, Spain

[73] Assignee: Majorica, S.A., Barcelona, Spain

[21] Appl. No.: 614,731

[22] Filed: May 25, 1984

[30] Foreign Application Priority Data

Dec. 28, 1983 [ES] Spain ..... 276.594

[51] Int. Cl.[4] ..... F16G 15/00

[52] U.S. Cl. ..... 24/116 A; 24/116 R; 24/327; 63/1 R

[58] Field of Search ..... 24/116 A, 116 R, 616, 24/618, 585, 70 J, 71 J, 265 WS, 327, 160; 63/1

[56] References Cited

U.S. PATENT DOCUMENTS

| | | | |
|---|---|---|---|
| 388,021 | 8/1888 | Byrne | 24/116 R |
| 2,113,786 | 4/1938 | Garfinkel | 24/616 |
| 2,930,209 | 3/1960 | Altman | 24/116 A |
| 3,094,754 | 6/1963 | Wayne | 24/116 A |
| 3,114,187 | 12/1963 | Wayne | 24/116 A |
| 3,181,217 | 5/1965 | Bohlinger et al. | 24/116 A |
| 3,271,977 | 9/1966 | Bohlinger et al. | 24/116 R |
| 3,309,743 | 3/1967 | Verri | 24/116 R |
| 3,323,324 | 6/1967 | Bohlinger et al. | 24/116 A |
| 3,481,155 | 12/1969 | Cook | 24/116 R |

*Primary Examiner*—Victor N. Sakran

*Attorney, Agent, or Firm*—Michael J. Striker

[57] ABSTRACT

A sliding hook for clasping pearl or similar jewelry necklaces that have both a free and a fixed end including a body having a rear side, a ring of a substantially open turn shape disposed on the body so as to allow for slightly oblique passing of the free end of the necklace, a joining point disposed on the rear side of the body for affixing the fixed end of the necklace, and an articulated annular blade having legs with tension and disposed on the rear side of the body so that the tension of the legs applied against the ring retains the pearl that is disposed between the ring and the annular blade and thus determines the length of the hanging free end of the necklace being passed through the ring.

7 Claims, 4 Drawing Figures

SLIDING HOOK DEVICE FOR CLASPING PEARL OR GLASS BEAD NECKLACES THAT HAVE A FREE HANGING END

BACKGROUND OF THE INVENTION

This invention relates to a sliding hook device for clasping pearl or glass bead necklaces. More particularly, it relates to a sliding hook device for clasping pearl or glass bead necklaces that have a free hanging end.

Sliding hook devices for clasping pearl or glass bead necklaces that have a free hanging end of the above mentioned general type are known in the art. The known hooking devices for clasping pearl or glass bead necklaces that have a free hanging end have drawbacks in their ability to retain the necklace hanging portion and in their ability to graduate at will the length of the hanging portion to modify the accommodation around the neck.

SUMMARY OF THE INVENTION

Accordingly, it is an object of the present invention to provide a sliding hooking device for clasping pearl or glass bead necklaces that have a free hanging end which avoids the disadvantages of the prior art.

More particularly, it is an object of the present invention to provide a sliding hooking device for clasping pearl or glass bead necklaces that have a free hanging end which offers general and important practical features in both the retention of the necklace hanging portion and the ability to graduate at will the length of the hanging portion and thus modify its accommodation around the neck.

In keeping with these objects, and with others which will become apparent hereinafter, one feature of the present invention resides, briefly stated, in a sliding hook for clasping pearl or similar jewelry necklaces that have both a free and a fixed end including a body having a rear side, a ring of a substantially open turn shape disposed on the body so as to allow for slightly oblique passing of the free end of the necklace, a joining point disposed on the rear side of the body for affixing the fixed end of the necklace wherein an articulated annular blade having legs with tension is disposed on the rear side of the body so that the tension of the legs applied against the ring retains the pearl that is disposed between the ring and the annular blade and thus determines the length of the hanging free end of the necklace being passed through the ring.

When the sliding hook for clasping pearls or similar jewelry necklaces that have a free end and a fixed end is designed in accordance with the present invention, the length of the hanging free end is slidably adjustable and the annular blade provides an improved means for achieving the clamped position of the necklace.

Another feature of the present invention is that the body is a visible ornamental structure composed of varying materials, shapes, and dimensions.

Yet another feature of the present invention is that the tension of the legs of the annular blade is applied against the backside of the ring.

Still another feature of the present invention is that the ring is a prolongation of sections emanating from the body.

Yet still another feature of the present invention is that the fixed end of the necklace is affixed by knotting to the joining point disposed on the rear side of the body.

Still yet another feature of the present invention is that the joining point is an adequately placed small ring.

Still another feature of the present invention is that the joining point is an adequately placed crosspiece.

Finally, still a further feature of the present invention is that the lugs emerging from the rear side of the body meet with points of the legs of the annular blade while the legs provide spring action that tends to maintain the annular blade in a clamped position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

The present invention consists of a piece of jewelry or imitation jewelry having a visible ornamental face 1. The face 1 contains pearls, gems or the like 2 and may also have reliefs, filigrees and other analogous designs.

Attached to the face 1 is a ring 3 disposed in a substantially open turned position. The ring 3 is defined by sections 4 which may be of a floral design, filigree or whatever may be appropriate. The sections 4 originate and terminate at the face 1 and thus form ring 3.

Figure 1:
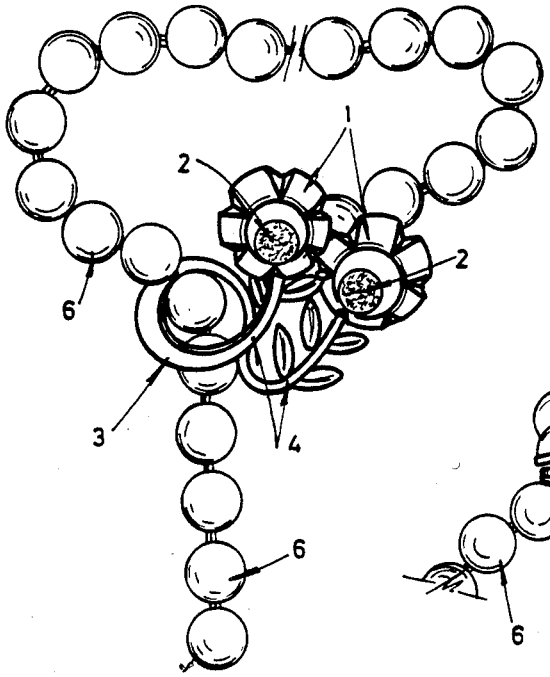
FIG. 1 is a front view of the present invention as applied to a pearl or glass bead necklace.
Figure 2:
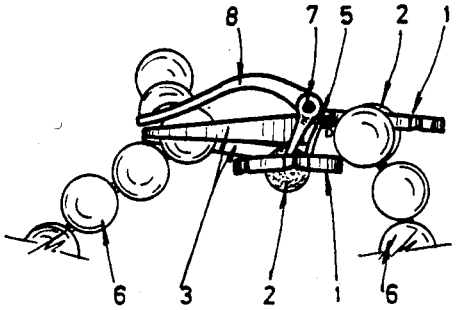
FIG. 2 is a plan view of the present invention of FIG. 1.
Figure 3:
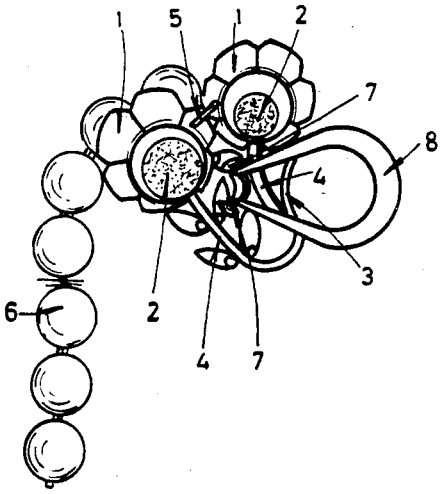
FIG. 3 is a rear view of the present invention of FIG. 1.
Figure 4:
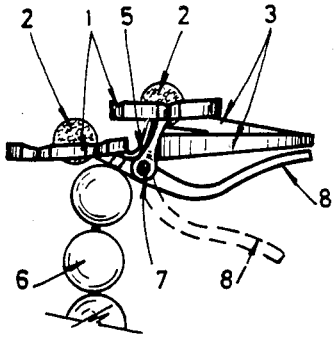
FIG. 4 is a plan view of the present invention of FIG. 1, in which the clasping and unclasping positions are shown.

The face 1 may be formed as one or more pieces and has on its back or invisible side, a small crosspiece 5 to which one of the ends of the pearl or glass bead string 6 that makes the necklace, bracelet or equivalent item is knotted. Also disposed on the back side are lugs 7 on which an annular blade 8 articulates. By the effect of the inherent tension of its legs, when compressed at their articulation points, annular blade 8 is maintained pressed against ring 3 (as can be seen in FIGS. 2, 3 and 4). Thus, a sort of clip is formed that is used to retain, between the two parts of the clasp, the pearls or glass beads 6 and thereby allow for adjustability of the length of the hanging end of the necklace (adapting more or less the necklace to any user's neck, as shown in FIG. 1).

While one of the necklace ends is secured to the crosspiece 5, the other end is passed obliquely through the ring 5 penetrating from the front side to the back side and hanging at the back side. This is accomplished by first holding the blade 8 which has been previously unclasped (as shown in FIG. 4 dotted line), then passing the necklace end through the ring 3 and then after obtaining the desired necklace hanging end length bring the blade 8 down on to the pearl that is inside the ring 3, and therefore produce the retention which prevents the necklace from becoming unclasped.

The present invention affords the ability to modify the length of the hanging string section of the necklace applied on the neck within the limits permitted by the necklace's total available length. A few pearls always remain hanging (FIG. 1), since this is a feature of passing and free-ended necklaces.

It is important to realize that the present invention always has an ornamental face 1 with a ring 3 to pass the necklace string 6 through, while the back side of the present invention contains the actual pressure clasping device which was previously described. Also, the necklace pearl that is held between the ring 3 and the annular blade 8 is not damaged by the applied tension due to its precise placement within the hollows or openings of the ring 3 and the blade 8. Additionally, the pearl string can run in both directions through the ring 3 and is immobilized by means of the blade 8 which has an inherent tension created due to the shape of its legs which articulate at the back of the present invention. Finally, the visible face of the present invention displays the ring 3 normally in a substantially open turned position to facilitate the oblique passing through of the pearls or glass beads. The orientation of the position of ring 3 is variable.

It will be understood that each of the elements described above, or two or more together, may also find a useful application in other types of constructions differing from the types described above.

While the invention has been illustrated and described as embodied in a pearl or glass bead necklace, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A sliding hook for clasping jewelry necklaces that have both a free and a fixed end and include a plurality of pearls or similar individual members, comprising:

a body having a rear side provided with emerging lugs;

a ring of a substantially open turn shape disposed on said rear side of said body so as to allow for slightly oblique passing of the free end of the necklace;

a joining point disposed on said rear side of said body for affixing the fixed end of the necklace; and an articulated annular blade having legs provided with points and being disposed on said rear side of said body, said blade having a shape corresponding to that of said pearls or similar individual members, said emerging lugs of said rear side of said body cooperating with said points of said legs of said annular blade so as to provide said legs with spring action, said blade being movable relative to said ring between an unclamped position in which a part of the necklace can be passed between said ring and said blade, and a clamped position in which the spring action of said legs applies toward said ring and retains between said ring and said annular blade the pearl or similar individual member at an end of the part of the necklace so as to selectively determine the length of the free end of the necklace being passed through and hanging out of said ring, said spring action of said legs further tending to maintain said annular blade in said clamped position.

2. The hook as defined in claim 1, wherein said body is a visible ornamental structure composed of variable materials, shapes and dimensions.

3. The hook as defined in claim 1, wherein said ring has a back side, said spring action of said legs of said annular blade is applied against said back side of said ring.

4. The hook as defined in claim 1, wherein said body has emanating sections, said ring being a prolongation emanating from said emanating sections of said body.

5. The hook as defined in claim 1, wherein said joining point disposed on said rear side of said body is formed so that the fixed end of the necklace is affixed by knotting to said joining point disposed on said rear side of said body.

6. The hook as defined in claim 1, wherein said joining point is formed as a small ring.

7. The hook as defined in claim 1, wherein said joining point is formed as a crosspiece.

* * * * *